US005500090A

United States Patent [19]

Autio

[11] Patent Number: 5,500,090

[45] Date of Patent: Mar. 19, 1996

[54] METHOD AND APPARATUS FOR GUIDING A FABRIC IN A PAPER MACHINE

[75] Inventor: Jukka Autio, Jyväskylä , Finland

[73] Assignee: Valmet Paper Machinery, Inc., Helsinki, Finland

[21] Appl. No.: 189,114

[22] Filed: Jan. 27, 1994

[30] Foreign Application Priority Data

Jan. 29, 1993 [FI] Finland ..... 930399

[51] Int. Cl.[6] ..... D21F 7/00

[52] U.S. Cl. ..... 162/273; 162/200; 226/15

[58] Field of Search ..... 226/1, 18, 15, 226/21; 162/200, 272, 274

[56] References Cited

U.S. PATENT DOCUMENTS

| | | | |
|---|---|---|---|
| 2,484,473 | 10/1949 | Staege | 74/241 |
| 3,724,732 | 4/1973 | Bonner | 266/21 |
| 3,750,920 | 8/1973 | Fountain et al. | 226/23 |
| 4,932,578 | 6/1990 | Pajula | 226/194 |

FOREIGN PATENT DOCUMENTS

| | | |
|---|---|---|
| 34867 | 8/1968 | Finland . |
| 84504 | 12/1987 | Finland . |
| 881290 | 9/1989 | Finland . |
| 930398 | 7/1994 | Finland . |
| 275954 | 7/1914 | Germany . |

OTHER PUBLICATIONS

Paperin Valimstus, Turku (1983, Finland) pp. 751, 757–759.

*Primary Examiner*—Brenda A. Lamb
*Attorney, Agent, or Firm*—Steinberg, Raskin & Davidson

[57] ABSTRACT

An apparatus and method for guiding the transverse position of a fabric in a paper machine, such as a drying wire, a press felt, or an equivalent fabric having an alignment roll for the fabric. The axial alignment of the alignment roll is regulated by a guide apparatus. In the guide apparatus, a sledge is arranged in connection with one or both of the bearing supports of the alignment roll. The position of the sledge in relation to the frame part of the apparatus is regulated by an actuator motor. The sledge of the guide apparatus is arranged on linear guides in the frame part of the apparatus and is guided by guides. The apparatus further includes a self-holding power transmission arrangement operated by the actuator motor.

19 Claims, 7 Drawing Sheets

METHOD AND APPARATUS FOR GUIDING A FABRIC IN A PAPER MACHINE

BACKGROUND OF THE INVENTION

The present invention relates to an apparatus in a paper machine for guiding the transverse position of a fabric, such as a drying wire, a press felt, or an equivalent fabric, and includes an alignment roll for the fabric. The axial alignment of the alignment roll is regulated by means of a guide apparatus, which comprises a sledge or equivalent arranged in connection with one or both of the bearing supports of the alignment roll. The position of the sledge or equivalent in relation to the frame part of the apparatus is regulated by means of an actuator motor.

Prior art wire guide apparatuses that are commonly used comprise a pneumatic bellows device arranged in connection with a bearing support of the alignment roll so that the axial alignment of the alignment roll can be altered, and the transverse position of the fabric can be regulated. In this respect, regarding the prior art related to the present invention, reference is made to the assignee's Finnish Patent No. 77,434 (corresponding to U.S. Pat. No. 4,932,578, the specification of which is hereby incorporated by reference herein).

It is a drawback of prior art bellows devices in a guide apparatus used for axial regulating the alignment roll that the height of the apparatus is quite large, and it is difficult to make the apparatus rigid enough, which causes problems, e.g., vibration. It is a further drawback of the prior art devices, that in the event of a failure in the supply of electricity, or of any other disturbance, the pressure is lost in the bellows, in which case the apparatus is usually shifted to one of its extreme positions. As a result, the fabric guided by the apparatus is guided to the side and is usually completely destroyed.

It is also a drawback of the prior art apparatuses for guiding a drying wire that the pneumatic bellows of the actuator have poor resistance to the temperatures present in the dryer section.

It is a further drawback of the prior art apparatuses that the position of their location is usually limited because the guides of the displaceable sledge of the guiding apparatus, the bearing support of the alignment roll being attached to this sledge, can be loaded in certain directions only.

It is another drawback of the prior art apparatuses that there is a considerable distance between the guides of the sledge and the area of action of the bellows devices. This produces torsion in the guides of the sledge with resulting detrimentally high friction forces, which make precise adjustment of the position even more difficult.

OBJECTS AND SUMMARY OF THE INVENTION

Accordingly, it is an object of the present invention to substantially eliminate the drawbacks of the prior art guiding apparatuses stated above and to provide a novel guiding apparatus with a more rigid construction, so that the problems of vibration can be substantially avoided.

It is a further object of the present invention to provide an apparatus whose construction is self-holding, so that, for example, in the event of failure in the supply of electricity or some other disturbance, it is locked in its latest position so that the fabric guided by the apparatus is not damaged.

Thus, the means for manual control can be omitted entirely, if necessary and desired.

It is another object of the present invention to provide a guiding apparatus by whose means a precise regulation of the position of the alignment roll can be achieved with low friction. By means of this regulation, even very small adjustments can be carried out without hysteresis in the position of the alignment roll and in the transverse position of the fabric that runs over the alignment roll.

It is yet another object of the present invention to provide a guiding apparatus in which there is substantially no interval between the moving sledge and the point of action of the force that displaces the sledge. As a result of this arrangement, the torsional moments, the resulting friction forces and the hysteresis are lowered.

In view of achieving the objects stated above, and others, the present invention is mainly characterized in that the sledge or equivalent of the guide apparatus is arranged on linear guide rails in the frame part of the apparatus to be guided by the guide rails in a substantially linear direction. The apparatus includes axial regulation means and a self-holding power transmission arrangement which is operated by the actuator motor of the apparatus to move a sledge guided by the guide rails. The self-holding power transmission arrangement comprises a shifting screw journalled on the frame part and a nut coupled to the screw and fixedly connected to the sledge. The shifting screw and the nut are arranged in combination with one another to transfer motive power from the motor to the sledge. The linear guide rails can be arranged to be loaded in directions transverse to a direction of movement of the sledge in the linear guides. In a preferred embodiment, there are at least two linear guide rails and at least two linear ball-bearing units arranged in connection with each of the linear guide rails. The combination of the shifting screw and the nut is arranged substantially symmetrically between the linear guide rails and substantially in a support plane of the linear guide rails.

It is an important advantage of the present invention that the guiding apparatus is arranged to be self-holding, so that, in the event of failure, it is locked in the latest running position, in which case the fabric guided by it cannot drift to the side and is not damaged.

According to the present invention, a play-free guiding apparatus of low friction is provided, by whose means the alignment of the alignment roll can be regulated very precisely without hysteresis. Owing to its linear guides and to the mutual fitting between the guides and the power transmission means, the guiding apparatus in accordance with the present invention is rigid and has very little play or flexibility, so that vibration problems caused by lack of rigidity can be substantially avoided.

In a preferred embodiment of the present invention, the point of action of the force that displaces the sledge and the plane of support of the linear guides are placed substantially in the same plane. In this case, the torsional moments and the resulting friction forces are lowered, as well as the height of the apparatus.

It is a further substantial advantage of the present invention that the apparatus can be placed, without changes in the construction, in any position whatsoever, even hanging downwards as suspended from its linear guides.

The guiding apparatus in accordance with the present invention can be made into a small size and closed package which is protected from outside contaminations, such as splashes.

In the method in accordance with the invention for guiding the transverse position of a fabric in a paper machine, an alignment roll is arranged to align a fabric to a desired transverse position. The alignment roll is supported at its ends on a frame part by bearing supports. A sledge is coupled to at least one of the bearing supports so that the movement of the sledge is controlled by arranging linear guide rails on the frame part to guide the sledge in a substantially linear direction. The axial alignment of the alignment roll is regulated by changing the position of the sledge in relation to the frame part.

The alignment roll is held rigidly in position during alignment of the fabric by means of a self-holding power transmission arrangement, which is, in a preferred embodiment, achieved by journalling a shifting screw on the frame part and connecting a nut to the sledge. The shifting screw has a self-holding square thread on an outer surface thereof, and the nut has an inner square thread cooperating with the square thread of the shifting screw such that upon rotation of the screw, the sledge is displaced.

In a preferred embodiment, the linear guide rails are fixed to the frame part and at least two linear ball bearing units are connected to the sledge and in connection with each of the linear guide rails. The linear guide rails are arranged such that a support plane of the linear guide rails and the linear ball bearing units is substantially the same plane as a power transmission point of the screw and the nut to thereby reduce the formation of torque at the linear guide rails and the linear ball bearing units.

The axial alignment of the alignment roll is regulated by arranging measurement detectors to monitor the transverse position of at least one edge of the fabric and generate a measurement signal based thereon. The measurement signal is passed to a regulation system wherein a regulation signal is generated. An actuator motor is controlled to displace the sledge based on the regulation signal. The self-holding power transmission arrangement can be arranged such that the sledge is movable only during actuation of the self-holding power transmission arrangement by the actuator motor to lock the sledge in its last position in the event of a power failure of the actuator motor.

BRIEF DESCRIPTION OF THE DRAWINGS

In the following, the prior art most closely related to the invention, problems involved in the prior art, and some preferred embodiments of the invention will be described in more detail with reference to the figures in the accompanying drawing.

DETAILED DESCRIPTION OF THE INVENTION

Figure 1A:
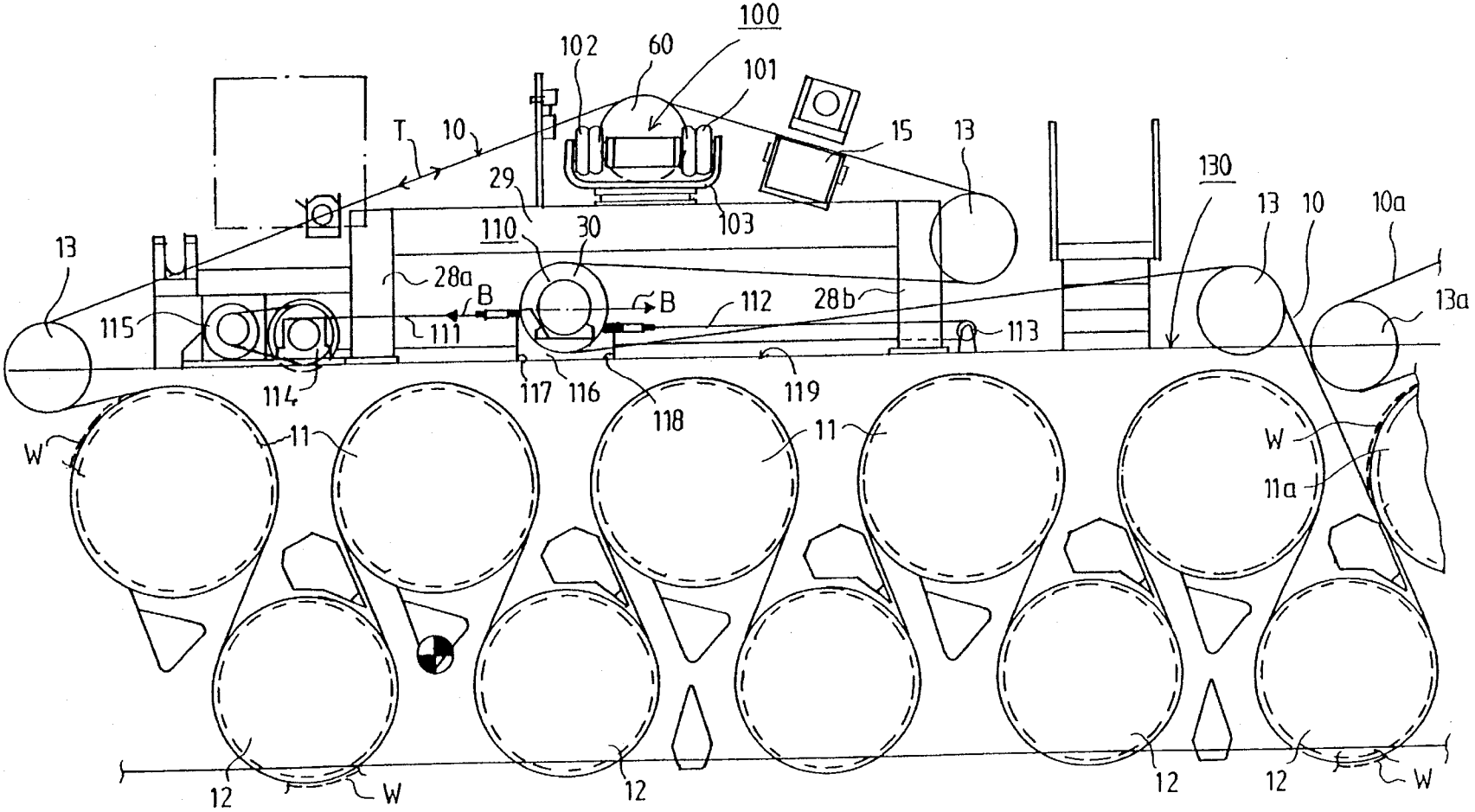
FIG. 1A shows a prior art tensioning device for a drying wire in the dryer section of a paper machine.

FIG. 1A is a schematic side view of a single-wire group in a multi-cylinder dryer of a paper machine, which comprises drying cylinders 11 arranged in an upper row and reversing suction cylinders 12 arranged in a lower row, below the upper row. A drying wire 10 is passed over the cylinders 11,12 so that, on the upper cylinders 11, a paper web W to be dried is placed in direct contact with and against the heated outer mantles of the cylinders. On the reversing suction cylinders 12, the web runs at the side of the outside curve. At the right side of FIG. 1A, the drying wire **10*a* of the next cylinder group, its guide roll 13*a*, and the drying cylinder 11*a* are shown. The drying wire 10 is conditioned by means of the conditioner devices 15. On the top of a frame part 130 of the dryer group, there is an auxiliary frame which comprises vertical parts 28*a* and 28*b* as well as a horizontal part 29**.

A prior art guiding device 100 for the drying wire 10 is arranged on the horizontal part 29 of the auxiliary frame. The axial alignment of an alignment roll 60 in the guiding device 100 is controlled by means of bellows 101 and 102 arranged inside a U-shaped frame part 103 of the guiding device. The drying wire 10 is guided by guide rolls 13 and tensioned by tensioning roll 30 of the tensioning device 110.

The prior art tensioning device 110 as shown in FIG. 1A comprises a tensioning roll 30, which is mounted on a carriage 116. The carriage 116 is displaced by the cooperation of wheels 117 and 118 on a beam 119 by means of cables 111 and 112. Cables 111, 112 run over reversing pulleys 113 and 114. The pulley 114 is driven by a motor 115. When the carriage 116 and the connected tensioning roll 30 are displaced by means of the motor 115 in the direction of the arrow B, the tension T of the loop of the drying wire 10 can be regulated.

In the following, with reference to FIG. 1B, a prior art guiding apparatus 100 for a press felt 20 of the press section in a paper machine and an environment of application of such an apparatus will be described.

Figure 1B:
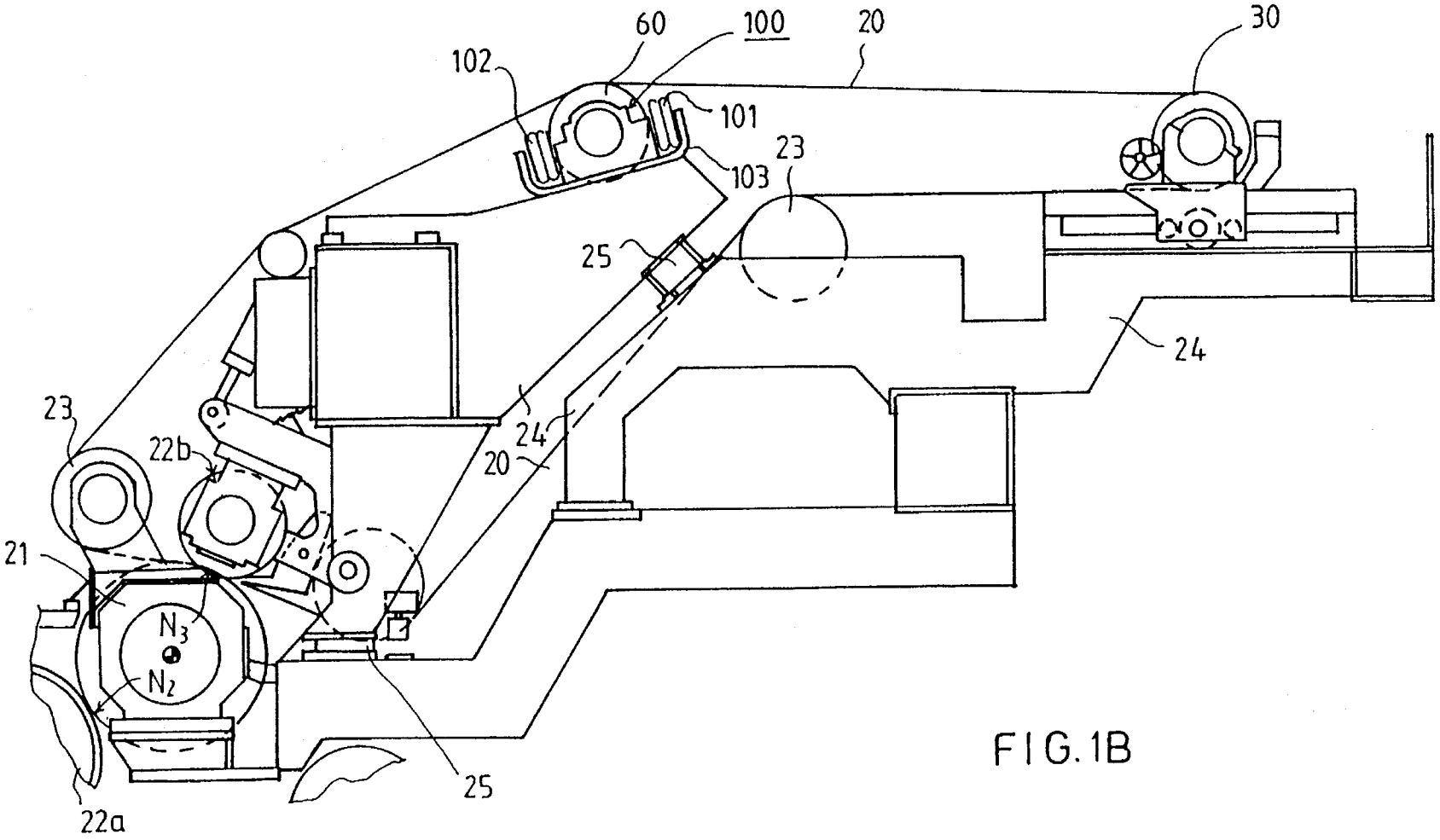
FIG. 1B shows a prior art upper-felt tensioning device in the dryer section of a paper machine.

FIG. 1B shows a compact press section of a paper machine, which comprises a suction roll **22*a*, a smooth-faced center roll 21, and a press roll 22*b*. In connection with the center roll 21, the second and the third nip $N_2$ and $N_3$ of the press section are formed. The first press nip (not shown) is formed underneath the suction roll 22*a*. Through the nip $N_3$, the press felt 20 runs and is guided by guide rolls 23 and alignment roll 60, and tensioned by tensioning roll 30. In connection with the frame part 24 of the paper machine, at the operating side of the machine, there are openable intermediate pieces 25, which enable the upper felt 20 to be replaced when the pieces 25 are opened. A prior art alignment device 100 for the control of the transverse position of the upper felt 20 is substantially similar to that described above in relation to FIG. 1A**.

Figure 1C:
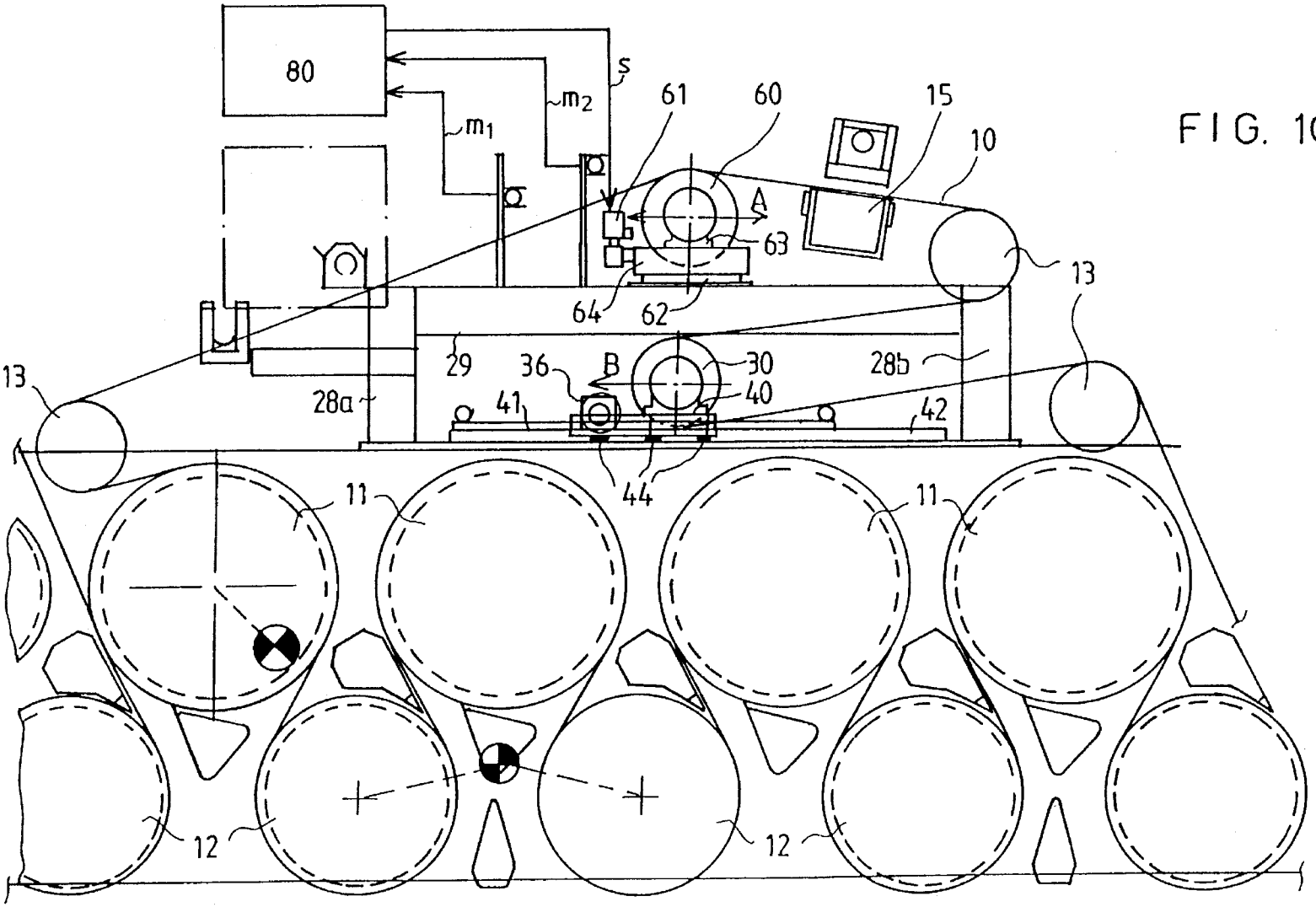
FIG. 1C shows an apparatus in accordance with the present invention for tensioning a drying wire in a dryer section, in a manner corresponding to FIG. 1A.

FIG. 1C is a schematic illustration of a guiding apparatus for a drying wire 10 in accordance with the present invention. The apparatus comprises a sledge 64, on which one of the bearing supports 63 of the alignment roll 60 is mounted. The sledge 64 is displaced in the direction of arrow A on a guide 26 arranged on the frame part 29 by means of the power of a motor 61.

Figure 2:
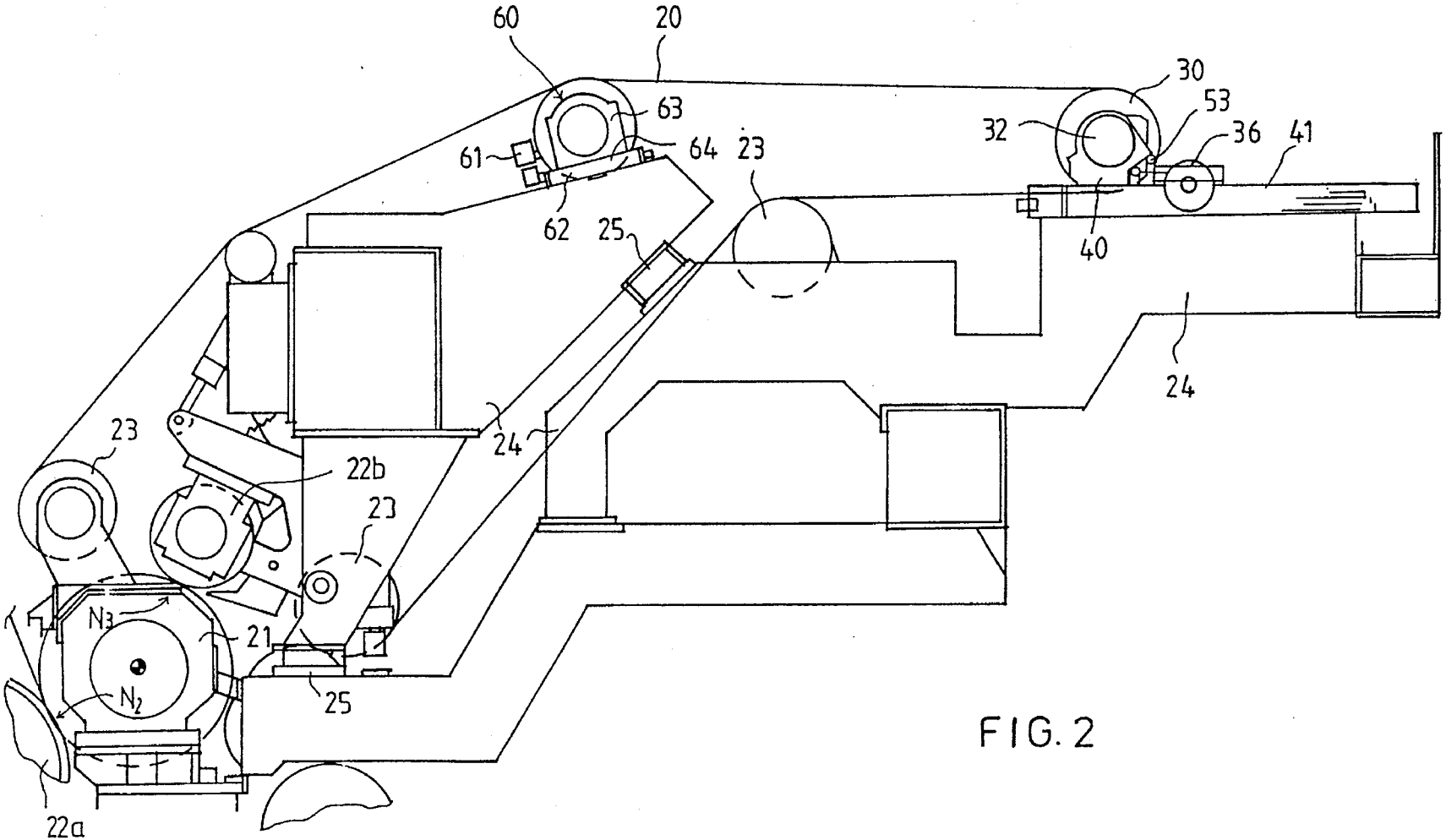
FIG. 2 shows an apparatus in accordance with the present invention for tensioning of an upper felt in a dryer section, in a manner corresponding to FIG. 1B.
Figure 3:
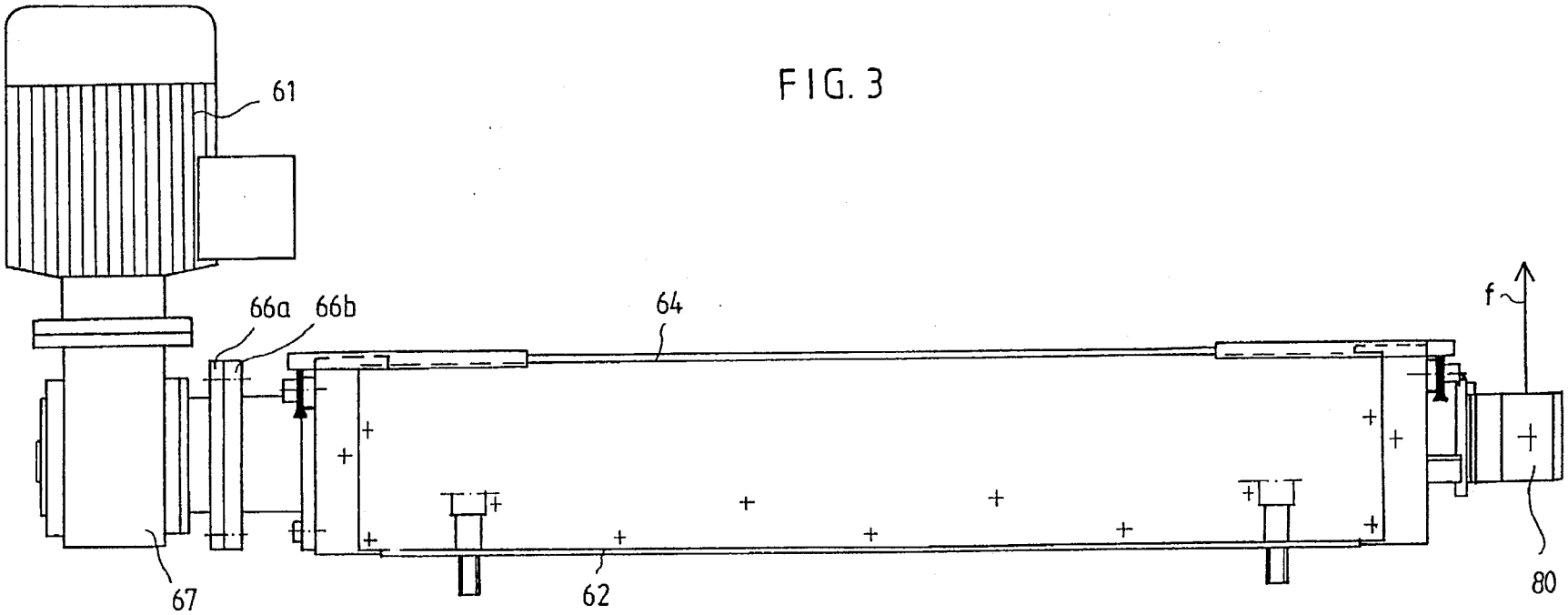
FIG. 3 is a side view of a guiding apparatus in accordance with the present invention.

In FIGS. 1C and 2, a device for displacement of the roll 30 for tensioning of fabrics 10,20 is shown, which is described in greater detail in Finnish Patent Application No. FI 930398, corresponding to U.S. patent application Ser. No. 08/189,115, which was filed on the same day as the present application. The device for displacement of the tensioning roll 30 comprises sledges 40 attached to bearing supports 32. The sledges are displaced along linear guides 42,44 and are driven by shaft 36 and rack 41. FIG. 2 shows a so-called splice-turning device 53 arranged between the sledge 40 and the bearing support 32. By means of the device 53, the alignment of the press-felt 20 tensioning roll 30 can be altered, i.e., regulated.

By means of the apparatus in accordance with the present invention, the axial alignment of the alignment roll 60 is adjusted by shifting the position of the bearing support 63 of the alignment roll 60 in the directions of the arrow A, in relation to a middle position, or neutral position, in a range of about ±60 mm. The opposite bearing support of the roll 60 is arranged to be stationary, in a manner in itself known. However, regulation of the other bearing support 63 in the direction of the arrow A is also possible. As an alternative, it is possible to place a guiding apparatus in accordance with the present invention in connection with each of the bearing supports 63 of the alignment roll 60. In this case, the opposite sledges 64 may be operated either in the same direction or in opposite directions.

The guide device comprises a motor 61, such as an electric motor, a pneumatic motor, or a hydraulic motor. The motor operates a shifting screw 65 by the intermediate of a bevel gear 67. The motor 61 and its bevel gear 67 are connected to the frame part 62 of the guiding apparatus by means of a flange joint **66*a*,66*b*. The frame part 62 is attached onto the top of the frame beam 29 of the dryer section as shown in FIG. 1C, and onto the frame part 24 of the press section as shown in FIG. 2**.

FIG. 1 also provides a schematic illustration of the regulation system 80, by whose means the transverse position of the drying wire 10 is regulated. The regulation system 80 comprises measurement detectors 81 and 82, by whose means the transverse position of one or both edges of the wire 10 is monitored. From these detectors 81,82, measurement signals $m_1$ and $m_2$ are received, respectively, which are passed to the system 80. From the system 80, a regulation signal s is received, by whose means the motor 61 of the guiding apparatus is controlled. The regulation system 80 also includes a set value unit, by whose means the transverse position of the wire 10 or, in a corresponding way, the transverse position of the press felt 20 shown in FIG. 2 or any other, equivalent fabric in a paper machine, can be regulated and kept in a position in accordance with the set value. Other regulation systems may also be applied in this invention.

Figure 4:
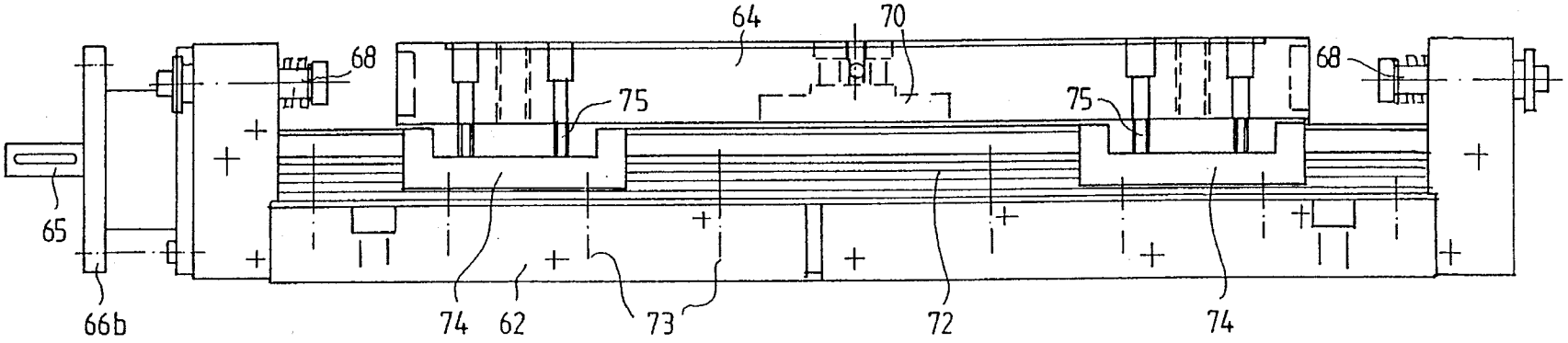
FIG. 4 shows a side view of a guiding apparatus in accordance with the present invention, with the shields of the box removed.
Figure 5:
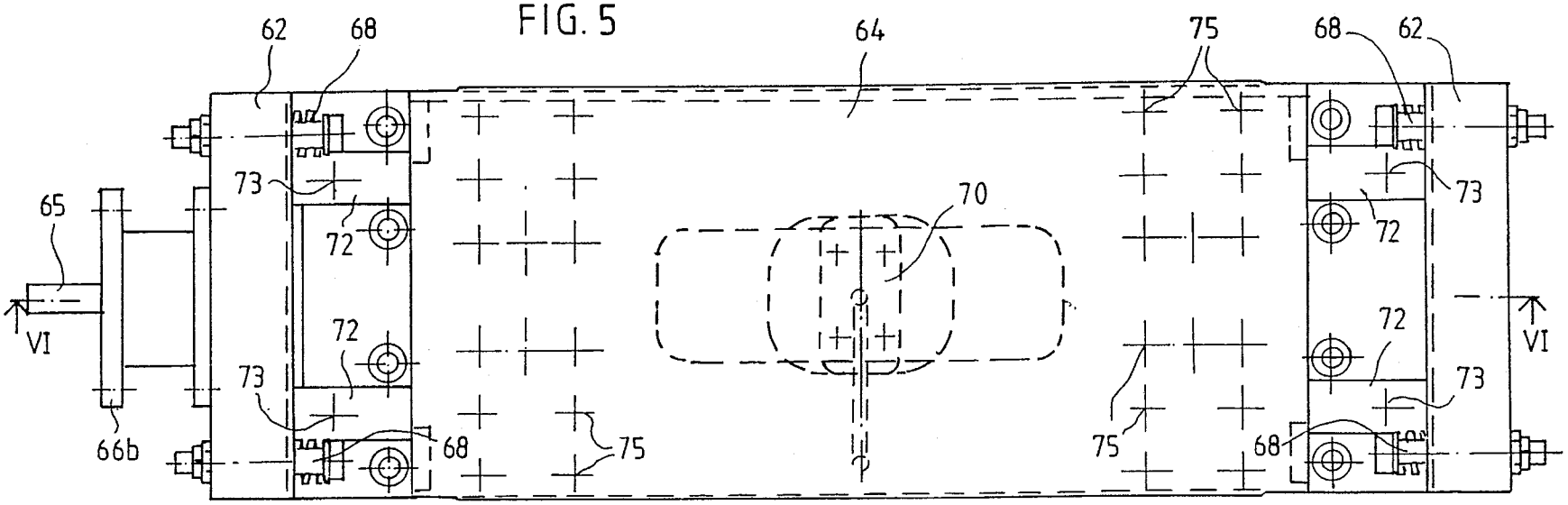
FIG. 5 shows a side view of a guiding apparatus in accordance with the present invention, viewed from above.
Figure 6:
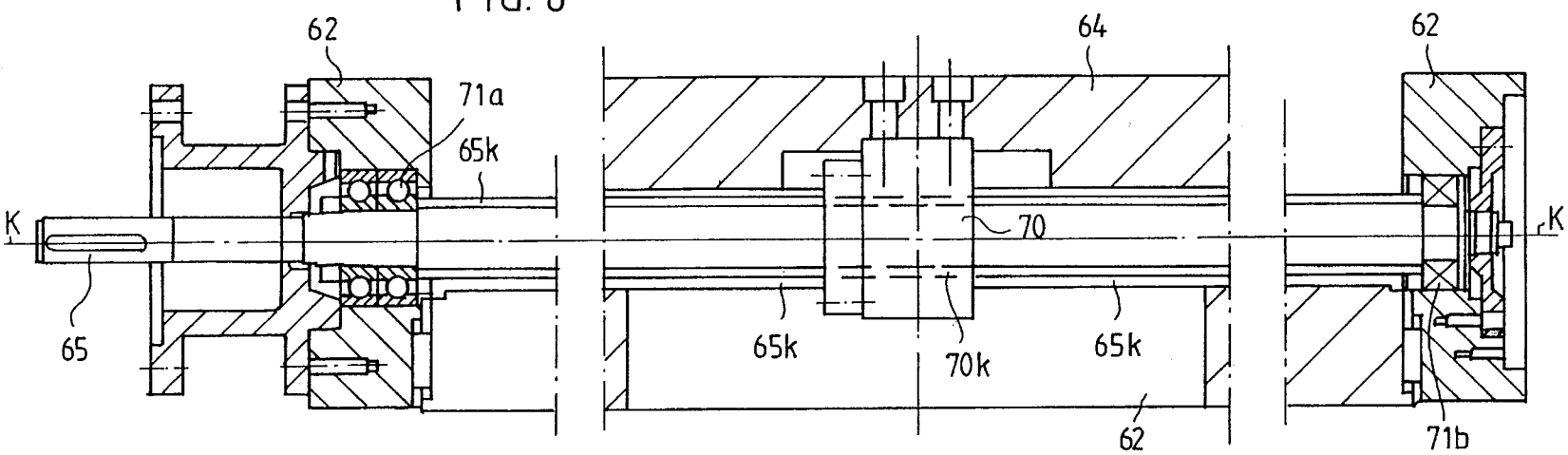
FIG. 6 is a vertical sectional view along the line VI—VI in FIG. 5.

The guiding apparatus, which is shown in more detail in FIGS. 3–8, comprises a sledge 64, on whose support the bearing support 3 of one of the axle journals of the alignment roll 60 is attached. The shifting screw 65 is supported at both of its ends in a revolving manner by means of bearings **71*a* and 71*b*, as shown in FIG. 6, arranged in connection with the frame part 62. The shifting screw 65 has a self-holding square thread 65*k* on which there is a shifting nut 70 having a corresponding inner square thread 70*k*. The shifting nut 70 is fixed in connection with the moving sledge 64 as shown in FIG. 6. At both sides of the sledge 64, in connection with the frame part 62, there are stops 68 provided with springs. The stops 68 limit the range of movement of the sledge 64 resiliently, preferably in a range of ±60 mm from the middle position or neutral position. Two guide rails 72 are attached to the top side of the frame part 62. The guide rails 72 are parallel to one another and extend over the entire length of the distance of movement of the sledge 64. Underneath the sledge 64, linear ball-bearing units 74 are fixed by means of screws 75, one such unit 74 being arranged in each corner of the sledge 64**.

Figure 7:
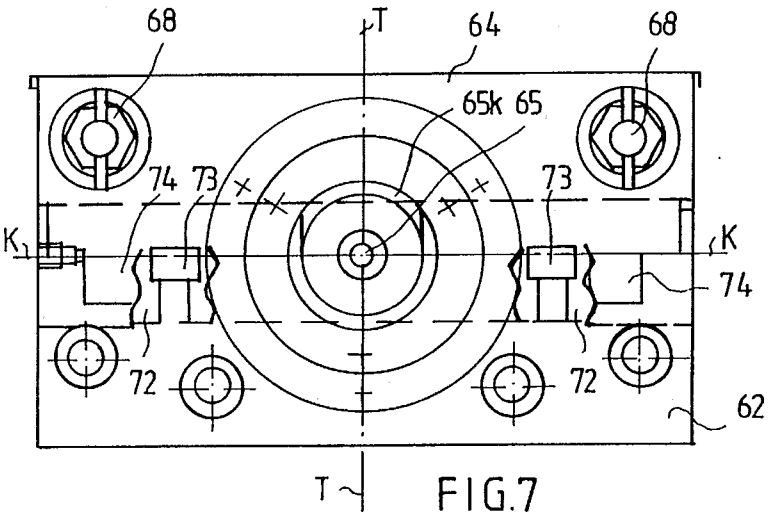
FIG. 7 is an end view of the apparatus as shown in the preceding illustrations.

As seen most clearly in FIGS. 6 and 7, the support planes of the guide rails 72 and of the linear ball-bearing units 74 are placed in the same plane K—K as the power transmission point of the shifting screw 65 and nut 70. As a result of this arrangement in accordance with the present invention, a torsional moment is not produced at the linear guides 72,74. Moreover, the construction is preferably symmetric in relation to the vertical central plane that passes through the central axis of the shifting screw 65. The vertical central plane is denoted with reference T—T in FIG. 7. In view of the symmetry of the construction, the detrimental torsional moments are also reduced.

In an alternate embodiment, the shifting screw in the guiding apparatus may be a ball screw (not shown), which is not self-holding, or an equivalent screw. In this embodiment, the locking of the sledge 64 upon failure in its latest position is arranged by means of the drive gear 67 of the shifting screw 65 and/or by means of a brake motor. At the right side of FIG. 3, the movement detector 80 is shown, which is connected to the shifting screw 65. From the movement detector 80, a signal f is received, which is passed to the regulation system 80 shown in FIG. 1C to indicate the position of the sledge 64 in the apparatus.

Figure 8:
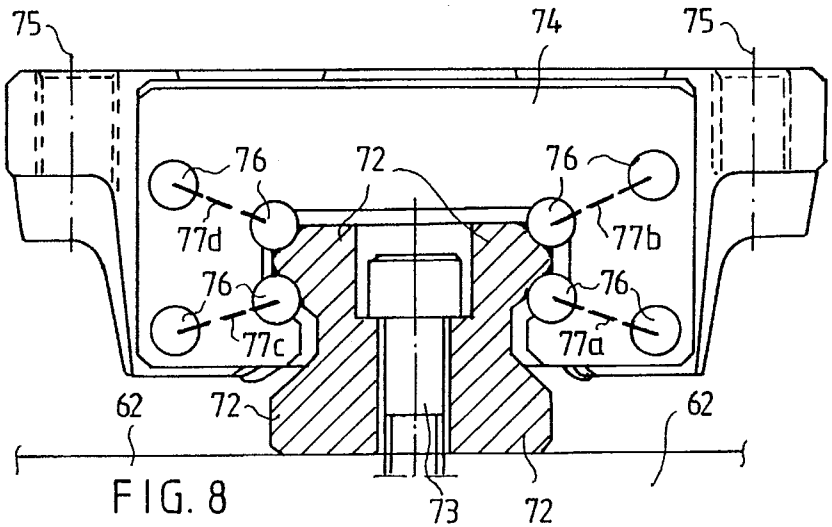
FIG. 8 shows a linear guide applied in the present invention as an illustration in the transverse direction of the guide rails.

Referring to FIG. 8, a preferred embodiment of the linear bearing arrangement of the sledge 64 will be described. The pairs of guide rails 72 are fixed to the frame part 62 by means of screws 73. On the guide rails 72, linear ball bearings 74 move. The ball bearings 74 are fixed to the sledge 64 by means of screws 75. As shown in FIGS. 4 and 5, there are two pairs of linear ball bearings 74 on the sledge 64. The linear ball bearings 74 are characterized by high loading capacity in all different directions transverse to the longitudinal direction of the guide rails 72 (and the direction of movement of the sledge in the guide rails), by adjustable small plays and by rigidity as well as by a relatively low friction. The linear guides of the sledge 64 comprise the guide rails 72, onto which four axial rolling grooves 78 for the bearings have been made. On the guide rails 72, ball bearing units 74 move. Bearing balls 76 are arranged in an interior of the ball bearing units 74. The bearing balls 76 perform a closed circulating movement in the loops **77*a*, 77*b*,77*c*,77*d* such that numerous successive balls that are "in turn" are supported with their carrying portions in each of the rolling grooves 78. The rolling grooves 78 on the guide rail 72 are placed in pairs and symmetrically so that each carrying row of bearing balls 76 transfers the contact load between the guide rail 72 and the ball bearing unit 74 at an angle of about 45° when examined in the sectional plane of FIG. 8. Owing to the arrangement of linear guides 72,74** described above, the guiding apparatus can be placed in any position whatsoever.

In this manner, an equally high loading capacity is obtained in four different directions, which permits the guiding apparatuses in accordance with the present invention to be placed in all sorts of different positions without substantial alterations in its construction. The linear guides 72,74 mentioned above are commercially available bearing components in themselves known.

In the following, the patent claims will be given, and the various details of the invention may show variation within the scope of the inventive idea defined in the claims and differ from what has been stated above for the sake of example only.

I claim:

1. Apparatus for transverselly positioning a fabric in a paper machine having a frame part, comprising an alignment roll for aligning a fabric to a desired transverse position, bearing supports coupled to said alignment roll for supporting axial ends of said alignment roll on the frame part of the paper machine, and means coupled to said alignment roll and the frame part for regulating the axial alignment of said alignment roll, the axial regulating means comprising a sledge arranged in connection with at least one of said bearing supports, linear guide means for guiding movement of said sledge in a substantially linear direction, said linear guide means comprising linear guide rails coupled to the frame part and linear ball bearing units arranged in connection with each of said linear guide rails, an actuator motor, and a self-holding power transmission arrangement operated by said actuator motor for moving said sledge guided along said linear guide rails of said linear guide means.

2. The apparatus of claim 1, wherein said self-holding power transmission arrangement comprises a shifting screw journalled on the frame part and a nut coupled to said screw, said nut being fixedly connected to said sledge, said shifting screw and said nut being arranged in combination with one another to transfer motive power from said actuator motor to said sledge.

3. The apparatus of claim 2, wherein said linear guide means comprise at least two of said linear guide rails and at least two of said linear ball bearing units arranged in connection with each of said at least two linear guide rails, the combination of said shifting screw and said nut being arranged substantially symmetrically between said linear guide rails and substantially in a plane of support provided by said linear guide rails.

4. The apparatus of claim 2, wherein said shifting screw is a threaded screw having a self-holding square thread on an outer surface thereof, said shifting screw being arranged to cooperate with an inner square thread on said nut such that rotation of said shifting screw causes movement of said nut and said sledge connected to said nut.

5. The apparatus of claim 1, wherein said linear guide means are arranged to be loaded in directions transverse to the linear direction of movement of said sledge.

6. The apparatus of claim 1, wherein said self-holding power transmission arrangement further comprises a drive gear or a brake motor, said shifting screw being arranged in connection with said drive gear or said brake motor such that said sledge is locked by said drive gear or said brake motor.

7. The apparatus of claim 1, further comprising limiter devices arranged between said frame part and ends of said sledge, said limiter devices comprising a spring for limiting the range of movement of said sledge.

8. The apparatus of claim 1, wherein a central plane is defined on a central axis of said shifting screw and perpendicular to a plane of support provided by said linear guide rails, said apparatus being arranged substantially symmetrical in relation to the central plane.

9. The apparatus of claim 1, further comprising screws for fixing said linear guide rails to the frame part.

10. The apparatus of claim 7, wherein said limiter devices limit the movement of said sledge and thus the end of said alignment roll supported by said at least one bearing support in a range of about 60 mm from a neutral position of said alignment roll.

11. The apparatus of claim 1, wherein said linear ball bearing units are fixed to said sledge and comprise bearing balls, said linear guide rails having axial rolling grooves, said bearing balls circulating in loops such that individual ones of said bearing balls are successively supported with their carrying portion in said rolling grooves.

12. The apparatus of claim 11, wherein said rolling grooves are arranged in symmetrical pairs such that said bearing balls transfer the contact load between said linear guide rails and said linear ball bearing units at an angle of about 45°.

13. The apparatus of claim 1, wherein said self-holding power transmission arrangement is arranged such that said sledge is movable only during actuation of said self-holding power transmission arrangement by said actuator motor.

14. A method for transversely positioning a fabric in a paper machine, comprising the steps of:

arranging an alignment roll to align a fabric to a desired transverse position, supporting said alignment roll at its axial ends on a frame part of the paper machine by bearing supports, coupling a sledge to at least one of said bearing supports, coupling linear guide rails to said frame part, coupling linear ball bearing units to said sledge and in connection with each of said linear guide rails, moving said sledge by means of a self-holding power transmission arrangement, and guiding the movement of said sledge in a substantially linear direction along said linear guide rails to regulate the axial alignment of said alignment roll.

15. The method of claim 14, wherein the step of moving said sledge by means of a self-holding power transmission arrangement, comprises the steps of journalling a shifting screw on said frame part, providing said shifting screw with a self-holding square thread on an outer surface thereof, connecting a nut to said sledge, and providing said nut with an inner square thread cooperating with said square thread of said shifting screw such that upon rotation of said screw, said sledge is moved in the linear direction.

16. The method of claim 15, further comprising the step of reducing the formation of torque at said linear guide rails and said linear ball bearing units by arranging a support plane of said linear guide rails and said linear ball bearing units to substantially correspond to a plane containing a power transmission point of said screw and said nut.

17. The method of claim 15, further comprising the steps of arranging measurement detectors to monitor the transverse position of at one edge of the fabric and generate a measurement signal based thereon, passing the measurement signal to a regulation system, generating a regulation signal in said regulation system, and controlling an actuator motor based on said regulation signal to rotate said screw and cause said sledge to move.

18. The method of claim 14, further comprising the step of arranging said self-holding power transmission arrangement such that said sledge is movable only during actuation of said self-holding power transmission arrangement by said actuator motor.

19. Apparatus for transversely positioning a fabric in a paper machine having a frame part, comprising an alignment roll for aligning a fabric to a desired transverse position, bearing supports coupled to said alignment roll for supporting axial ends of said alignment roll on the frame part of the paper machine, and means coupled to said alignment roll and the frame par% for regulating the axial alignment of said alignment roll, said axial regulating means comprising a movable sledge arranged in connection with at least one of said bearing supports, linear guide means for guiding movement of said sledge in a substantially linear direction, said linear guide means being arranged to be loaded in directions transverse to the linear direction of movement of said sledge, an actuator motor, and a self-holding power transmission arrangement operated by said actuator motor for moving said sledge guided by said linear guide means.

* * * * *